US011589164B2

(12) United States Patent
Zettl et al.

(10) Patent No.: US 11,589,164 B2
(45) Date of Patent: Feb. 21, 2023

(54) ACOUSTIC TRANSDUCER INCLUDING A MODIFIED MEMBRANE

(71) Applicant: The Regents of the University of California, Oakland, CA (US)

(72) Inventors: Alexander K. Zettl, Kensington, CA (US); Stephen M. Gilbert, Albany, CA (US); Donez J. Horton-Bailey, El Cerrito, CA (US); Hu Long, El Cerrito, CA (US)

(73) Assignee: The Regents of the University of California, Oakland, CA (US)

( * ) Notice: Subject to any disclaimer, the term of this patent is extended or adjusted under 35 U.S.C. 154(b) by 55 days.

(21) Appl. No.: 17/266,539

(22) PCT Filed: Aug. 6, 2019

(86) PCT No.: PCT/US2019/045360
§ 371 (c)(1),
(2) Date: Feb. 5, 2021

(87) PCT Pub. No.: WO2020/033445
PCT Pub. Date: Feb. 13, 2020

(65) Prior Publication Data

US 2021/0321198 A1 Oct. 14, 2021

Related U.S. Application Data

(60) Provisional application No. 62/715,962, filed on Aug. 8, 2018.

(51) Int. Cl.
*H04R 7/06* (2006.01)
*H04R 7/18* (2006.01)
*H04R 19/00* (2006.01)
*H04R 19/02* (2006.01)

(52) U.S. Cl.
CPC ..... *H04R 7/06* (2013.01); *H04R 7/18* (2013.01); *H04R 19/005* (2013.01); *H04R 19/02* (2013.01); *H04R 2307/023* (2013.01); *H04R 2307/204* (2013.01)

(58) Field of Classification Search
CPC . H04R 7/18; H04R 7/06; H04R 19/05; H04R 19/02; H04R 2307/02; H04R 2307/204
See application file for complete search history.

(56) References Cited

U.S. PATENT DOCUMENTS

2012/0148071 A1* 6/2012 Dehe ..... H04R 1/005 216/13
2014/0247954 A1* 9/2014 Hall ..... H04R 17/02 381/92
2018/0066980 A1* 3/2018 Zhou ..... H04R 19/005

FOREIGN PATENT DOCUMENTS

DE 102017203912 A1 7/2017

OTHER PUBLICATIONS

Blees, Melina K. et al., "Graphene kirigami," Nature, Aug. 2015, vol. 524, pp. 204-207, https://doi.org/10.1038/nature14588.

(Continued)

*Primary Examiner* — Sunita Joshi
(74) *Attorney, Agent, or Firm* — Womble Bond Dickinson (US) LLP

(57) ABSTRACT

This disclosure provides systems, methods, and apparatus related to acoustic transducers.

36 Claims, 12 Drawing Sheets

(56) References Cited

OTHER PUBLICATIONS

Zhou, Qin et al., "Graphene electrostatic microphone and ultrasonic radio," PNAS, Jul. 2015, vol. 112, No. 29, https://doi.org/10.1073/pnas.1505800112.
Zhou, Qin et al., "Electrostatic graphene loudspeaker," Applied Physics Letters, 102, 223109 (2013); AIP Publishing, https://doi.org/10.1063/1.4806974.
Zhao, Zhouying et al., "Enhanced ultraviolet response using graphene electrodes in organic solar cells," Applied Physics Letters, 101, 063305 (2012); AIP Publishing, https://doi.org/10.1063/1.4742928.
Zhang, Di et al., "Polymer solar cells with gold nanoclusters decorated multi-layer graphene as transparent electrode," Applied Physics Letters, 99, 223302 (2011); AIP Publishing https://doi.org/10.1063/1.3664120.
Xu, S.C. et al., "Flexible and transparent graphene-based loudspeakers," Applied Physics Letters, 102, 151902 (2013); AIP Publishing, https://doi.org/10.1063/1.4802079.
Todorovi, Dejan et al., "Multilayer graphene condenser microphone," 2D Materials, 2015, vol. 2, No. 1, IOP Publishing, http://dx.doi.org/10.1088/2053-1583/2/4/045013.
Sahin, R. et al., "Nanoscale patterning of graphene through femtosecond laser ablation," Applied Physics Letters, 104, 053118 (2014); AIP Publishing, https://doi.org/10.1063/1.4864616.
Barton, Robert A. et al., "High, Size-Dependent Quality Factor in an Array of Graphene Mechanical Resonators," Mano Letters, 2011, vol. 11, No. 3, pp. 1232-1236, American Chemical Society, dx.doi.org/10.1021/nl1042227.
Begtrup, G. E. et al., "Nanoscale Reversible Mass Transport for Archival Memory," Nano Letters, 2009, vol. 9, No. 5, pp. 1835-1838, American Chemical Society.
Fei, Wenwen et al., "Low-voltage Driven Graphene Foam Thermoacoustic Speaker," Small, 2015, vol. 11, Issue No. 19, pp. 2252-2256, Wiley-VCH Verlag GmbH & Co. KGaA, Weinheim, https://onlinelibrary.wiley.com/doi/10.1002/smll.201402982.
Jensen, K. et al., "Nanotube Radio," Nano Letters, 2007, vol. 7, No. 11, pp. 3508-3511, American Chemical Society.
International Search Report and Written Opinion for International Application No. PCT/US2019/045360, dated Oct. 10, 2019.
Transmittal of the International Search Report and Written Opinion of the International Searching Authority dated Feb. 18, 2021, for International Application No. PCT/US2019/045360, filed Aug. 6, 2019, pp. 8.

* cited by examiner

ACOUSTIC TRANSDUCER INCLUDING A MODIFIED MEMBRANE

PRIORITY AND RELATED APPLICATIONS

This application claims priority to PCT National Stage Application No. PCT/US19/45360, filed Aug. 6, 2019, which claims priority to U.S. Provisional Patent Application No. 62/715,962, filed Aug. 8, 2018, which is herein incorporated by reference. This application is also related to U.S. patent application Ser. No. 14/737,903, filed Jun. 12, 2015, and to U.S. patent application Ser. No. 15/558,467, filed Feb. 24, 2016, both of which are herein incorporated by reference.

STATEMENT OF GOVERNMENT SUPPORT

This invention was made with government support under Contract No. DE-AC02-05CH11231 awarded by the U.S. Department of Energy. The government has certain rights in this invention.

TECHNICAL FIELD

This disclosure relates generally to acoustic transducers.

BACKGROUND

Graphene speakers and microphones have demonstrated wide-band frequency response in the audio and ultrasonic frequencies. FIG. 1A shows an example of a cross-sectional schematic illustration of a speaker including a graphene membrane suspended between two perforated electrodes. These acoustic transducers comprise a suspended graphene membrane separated by spacers on each side from two air permeable electrodes. The graphene membrane in these transducers is generally 1 millimeter (mm) to 10 mm in diameter to achieve wide-band, audio- and ultrasonic-frequency response (e.g., 20 Hz-10 GHz).

Using current techniques, the membrane generally cannot be made any smaller than this range (i.e., smaller than 1 mm) while maintaining good audio-frequency response. Making the membrane smaller than 1 mm increases the resonant frequency and decreases the bandwidth of the membrane. As shown in FIG. 1B, shrinking the membrane not only leads to a sharper frequency response, but also shifts the response out of the audible range and into the ultrasonic range. Shrinking the membrane also reduces the volume displacement of the membrane, resulting in a quieter sound. The relationship between the diameter of the membrane and its amplitude and frequency response is illustrated in FIG. 1B. FIG. 1B thus demonstrates using current techniques, the membrane needs to be larger than 1 mm in diameter to provide wideband response and be effective for audio frequencies.

SUMMARY

Contrary to current approaches, the inventors of the present application have designed novel small diameter diaphragms, including graphene diaphragms, that produce a wideband response, as well as novel techniques for making such diaphragms. These techniques also permit adjustment of frequency, bandwidth, amplitude, or directionality (i.e., broadcasting or receiving audio signal in a specific direction) of the acoustics of the diaphragm, allowing device customization and efficacy in the human audible range, even for diaphragms smaller than 1 mm across. These novel diaphragms also exhibit greater volume displacement as compared to traditional diaphragms, thereby generating a comparatively louder sound. Furthermore, a lower signal voltage may be used to operate these novel diaphragms compared to the voltage required to operate traditional diaphragms having similar diameters. Using a lower voltage permits substantial miniaturization of not only the diaphragm but also its associated electronics and also reduces battery capacity requirements in portable or wireless devices (e.g., smartphones, speakers, headsets, microphones, sensors, etc.) incorporating such diaphragms.

Thus, in one aspect, the present application describes membranes, including graphene membranes, patterned to adjust the effective spring constant of the membrane. This modification permits tuning the frequency, bandwidth, amplitude, or directionality (i.e., broadcasting or receiving audio signal in a specific direction) of the membrane. When the membrane is incorporated into a transducer, the transducer can produce a customized, broadband response in frequency ranges that are inaccessible to small diaphragms made using traditional approaches. Furthermore, when using a membrane according to the present application, the voltage required to drive response in the transducer is decreased, enabling miniaturization of transducer electronics while maintaining high performance.

In another aspect, the present application describes an acoustic transducer including a suspended membrane (e.g., graphene (single layer or multilayer), a two-dimensional material (e.g., $MoS_2$), a metal, a semiconductor, or a polymer) as an acoustic-transducer material that is modified to alter the mechanical properties of the membrane. The modification of the membrane can adjust the frequency, bandwidth, amplitude, or directionality (i.e., broadcasting or receiving audio signal in a specific direction) of the acoustic transducer. The transducer may function as a loudspeaker, a microphone, or both. In another aspect, the present application describes a device incorporating such a transducer, for example a sensor, smartphone or wearable device, speaker, microphone, headset, etc.

In another aspect, the present application describes a method of generating an acoustic wave using an acoustic transducer, preferably having a softened graphene diaphragm. In another aspect, the present application describes a method of measuring the frequency and/or amplitude of a sound wave using an acoustic transducer, preferably having a softened graphene diaphragm.

In another aspect, the present application describes a method of producing a membrane, preferably a softened graphene membrane. In another aspect, the present application describes a method of producing a transducer, preferably including a softened graphene membrane.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

As shown in FIG. 2B, the majority of the deformation occurs in the outer cuts, confirming an increased compliance of the speaker.

DETAILED DESCRIPTION

Figure 1A:
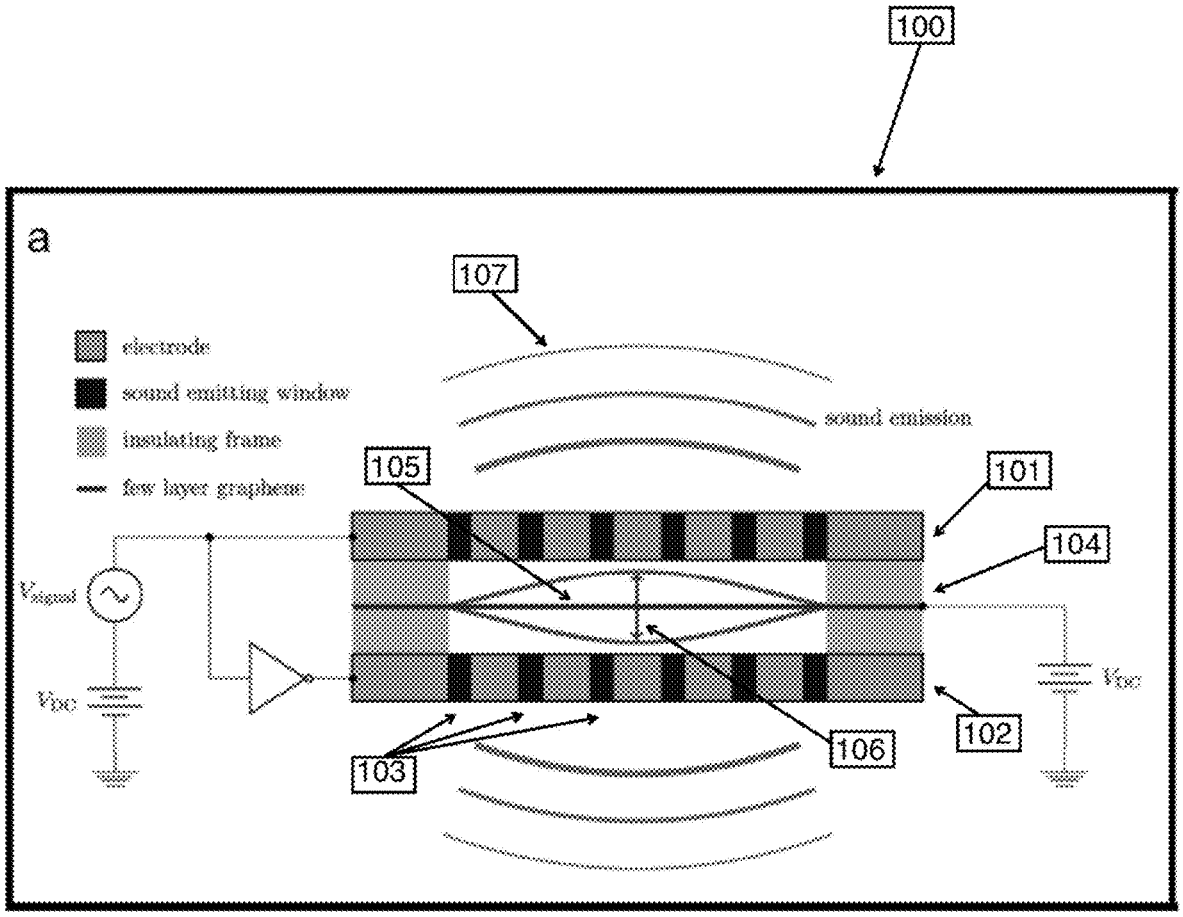
FIG. 1A shows an example of a cross-sectional schematic illustration of a speaker including a graphene membrane suspended between two perforated electrodes. An AC signal on the electrodes is used to oscillate the membrane to produce acoustic waves.

Reference will now be made in detail to some specific examples of the subject matter of the present application including the best modes contemplated by the inventors for carrying out such subject matter. Examples of these specific embodiments are illustrated in the accompanying drawings. While the subject matter is described in conjunction with these specific embodiments, it will be understood that it is not intended to limit the application to the described embodiments. On the contrary, the application is intended to cover alternatives, modifications, and equivalents as may be included within the spirit and scope of the subject matter of the present application, including as defined by the appended claims.

Particular example embodiments of the subject matter of the present application may be implemented without some or all of these specific details. In other instances, well known process operations have not been described in detail in order not to unnecessarily obscure the present subject matter.

Various techniques and mechanisms of the present application will sometimes be described in singular form for clarity. However, it should be noted that some embodiments include multiple iterations of a technique or multiple instantiations of a mechanism unless noted otherwise.

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a value is close to a targeted value, where close can mean, for example, the value is within 80% of the targeted value, within 85% of the targeted value, within 90% of the targeted value, within 95% of the targeted value, or within 99% of the targeted value.

The term "infrasonic" when referring to an acoustic wave means the acoustic wave has a frequency below the human audible range, i.e. below 20 Hz. The term "ultrasonic" when referring to an acoustic wave means the acoustic wave has a frequency above the human audible range, i.e. above 20 kHz. The term "human audible range" or the like when referring to an acoustic wave means the acoustic wave has a frequency within the human audible range, i.e. between 20 Hz and 20 kHz.

The term "pristine" when referring to a diaphragm means a diaphragm that has not been altered, e.g. patterned, etched, mass-loaded, or otherwise modified according to the techniques and approaches set forth in this application.

An acoustic wave may be referred to as a sound wave in various parts of this application, or vice versa.

An acoustic transducer has two modes of operation: one mode in which it converts electrical signals to acoustic waves and one mode in which it converts acoustic waves to electrical signal. In some embodiments, the acoustic transducer operates in the same manner as the devices described in U.S. patent application Ser. No. 14/737,903 and U.S. patent application Ser. No. 15/558,467.

As shown in FIG. 1A, an acoustic transducer 100 including a patterned graphene membrane 105 can be used to generate acoustic waves by applying an AC voltage (with a DC offset) between the electrodes and the graphene membrane (the AC voltage is inverted between the top and bottom electrode). The acoustic transducer 100 includes a first electrode 101 and a second electrode 102. Each of the electrodes 101, 102 include a plurality of sound emitting windows 103 and an insulating frame 104. The patterned graphene membrane 105 is arranged in the insulating frame 104. To generate acoustic waves, an AC voltage is applied to the first electrode 101 and the second electrode 102. The AC voltage is inverted between the first electrode 101 and the second electrode 212. The AC voltage capacitively couples to the patterned graphene membrane 105, causing the patterned graphene membrane 105 to oscillate (as shown by arrow 106) with the AC signal due to the electrostatic force on the patterned graphene membrane 105. As the patterned graphene membrane 105 moves in and out of its original plane, air is pushed, producing sound emission 107. Conversely, by measuring the voltage at the electrodes rather than feeding an AC voltage, electrical oscillations can be measured as sound excites the motion of the graphene membrane. This allows for the acoustic transducer to also be used as a microphone.

Using the techniques set forth in U.S. patent application Ser. No. 14/737,903 and U.S. patent application Ser. No. 15/558,467, it is possible to construct a transducer having graphene diaphragm which provides wideband frequency response in both the audible and ultrasonic ranges. To produce a wideband response, however, both applications generally utilize graphene membranes having diameters of at least 3 mm.

Figure 1B:
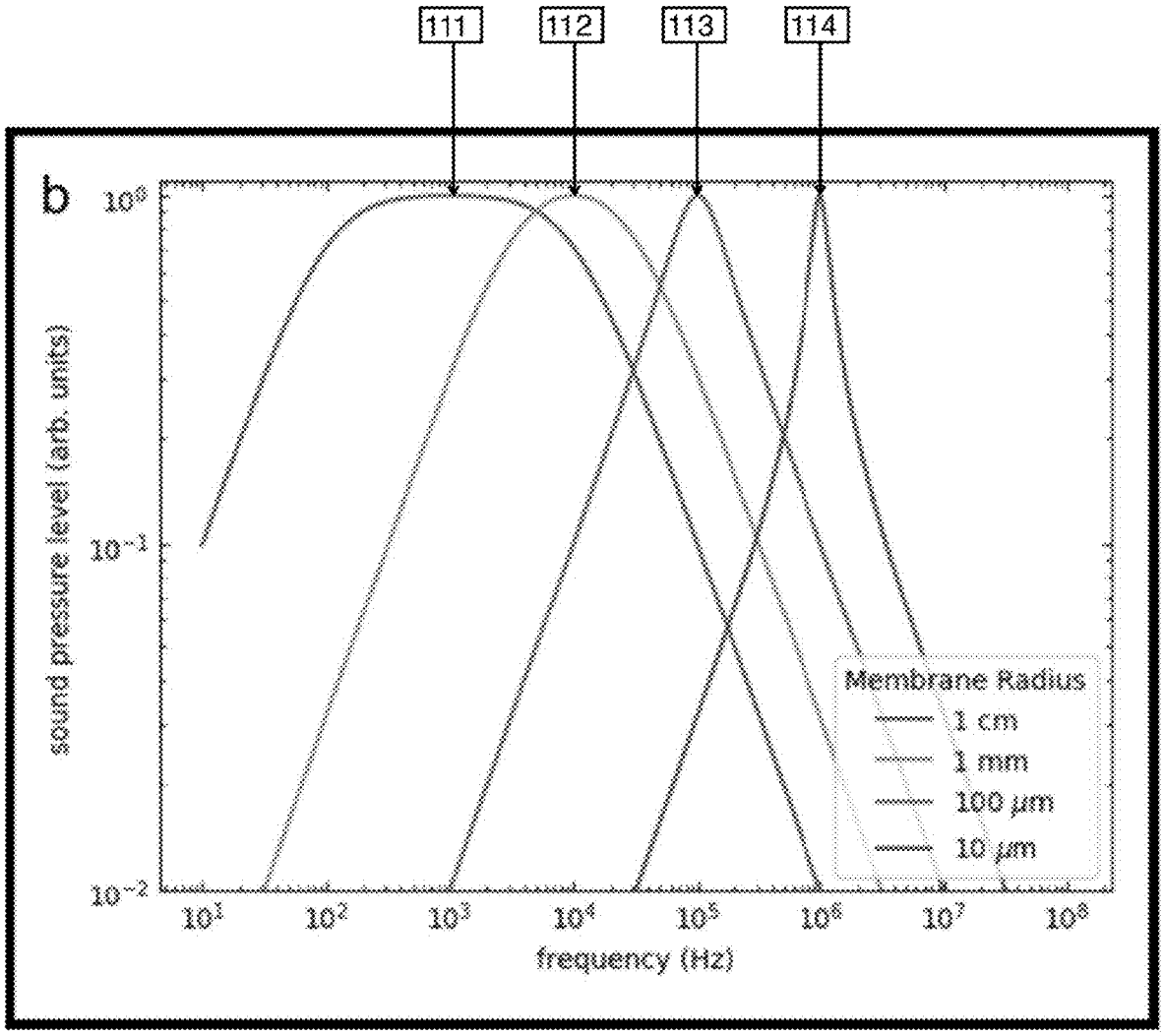
FIG. 1B shows the simulated frequency response of graphene membranes having a constant thickness (i.e., 50 nanometers) and stress, but with varying radii.

The ability to reduce the diameter of membranes in acoustic wideband transducers to a range between about one micron (μm) to one millimeter (mm) would enable new applications and increase the production yield for graphene speakers. However, as shown in FIG. 1B, reducing the diameter of a traditional or typical membrane increases the resonant frequency of the membrane, decreases its frequency-range of response, and decreases its amplitude of oscillation. In FIG. 1B, the vertical axis shows sound pressure level and the horizontal axis shows frequency (Hz). Line 111 corresponds to a traditional or pristine membrane having a radius of 1 cm, line 112 corresponds to a traditional or pristine membrane having a radius of 1 mm, line 113 corresponds to a traditional or pristine membrane having a radius of 100 μm, and line 114 corresponds to a traditional or pristine membrane having a radius of 10 μm. As the radius of the membrane decreases, FIG. 1B shows the frequency-range of the response decreases and shifts further into the ultrasonic range. This change in properties renders traditional membranes smaller than one millimeter inoperable as wideband transducers and inoperable in the human audible range.

The inventors of the present application have overcome such size limitations and have invented small diameter transducers that do not exhibit the drawbacks discussed above. Such transducers include a suspended membrane (e.g., graphene (single layer or multilayer), a two-dimensional material (e.g., $MoS_2$), a metal, a semiconductor, or a polymer) as an acoustic-transducer material that is modified to alter the mechanical properties of the membrane. The modification of the membrane can adjust the frequency, bandwidth, amplitude, or directionality (i.e., broadcasting or receiving audio signal in a specific direction) of the acoustic transducer. While the acoustic transducers described herein are generally described as including a graphene membrane, an acoustic transducer may include any of the aforementioned membranes.

In some embodiments, a membrane, preferably a graphene membrane, is modified by one of the following techniques: etching of the graphene, mass-loading of the graphene, or chemical modification of the graphene. The etching, mass-loading, or chemical modification of the graphene membrane may be performed by ion beam irradiation, laser irradiation, electron beam lithography, photolithography, or metal evaporation. Other methods may also be used.

In some embodiments, the etching, mass-loading, or chemical modification of the membrane creates cuts in the membrane. These cuts reduce the spring constant of the membrane and therefore "soften" the membrane as compared to a membrane without the cuts. In some embodiments, these cuts are radial cuts. In some embodiments, these cuts are azimuthal cuts. In some embodiments, these cuts are radial and azimuthal cuts. In some embodiments, the cuts permit a central region of the membrane to be in a different plane and rotated relative to the edges of the membrane. With patterned cuts, the graphene membrane stiffness can be softened allowing for broader and lower frequency responses. The mechanical properties of the patterned graphene membrane are determined, in part, by the width, the length, and the number of cuts. The frequency response of a graphene membrane can be changed by changing the geometry and number of these cuts.

In some embodiments, the etching, mass loading, or chemical modification of the membrane creates open regions in the graphene membrane. The open regions reduce the spring constant of the membrane and therefore "soften" the membrane as compared to a membrane without openings. In some embodiments, these open regions may be slits, holes, or other openings. In some embodiments, the holes are circular shaped. In some embodiments the holes are v-shaped, square, elliptical, kidney, star, n-polygonal, etc. In some embodiments, the holes have a diameter of about 20 nanometers to 60 nanometers.

In some embodiments, the mass of the graphene membrane is reduced. For example, in some embodiments, the mass of the graphene membrane is reduced by defining holes in the graphene membrane. This may be referred to as perforating the membrane. A graphene membrane defining regular holes reduces the mass and damping of the membrane and increases the resonant frequency of the membrane. In some embodiments, the holes are circular shaped. In some embodiments the holes are v-shaped, square, elliptical, kidney, star, n-polygonal, etc. In some embodiments, the holes have a diameter of about 20 nanometers to 60 nanometers.

In some embodiments, the etching, mass loading, or chemical modification of the graphene membrane creates a membrane having a mass disposed thereon. In some embodiments, the mass is a circularly shaped mass. In some embodiments, the mass is v-shaped, square, elliptical, kidney, star, n-polygonal, etc. In some embodiments, the mass comprises a metal.

In some embodiments, a mass is deposited on a surface of the graphene membrane in an anisotropic pattern. This approach would split the fundamental resonant frequencies, allowing for multiple peaks in the audible range. In some embodiments, by changing the mass and pattern of the material deposited on the graphene membrane, the full width at half maximum of the frequency response can be reduced, allowing for sharp frequency responses in the audible-acoustic regime (FIG. 4B). In some embodiments, this feature can be used an integrated band pass filter for sound generation and detection.

Figure 2A:
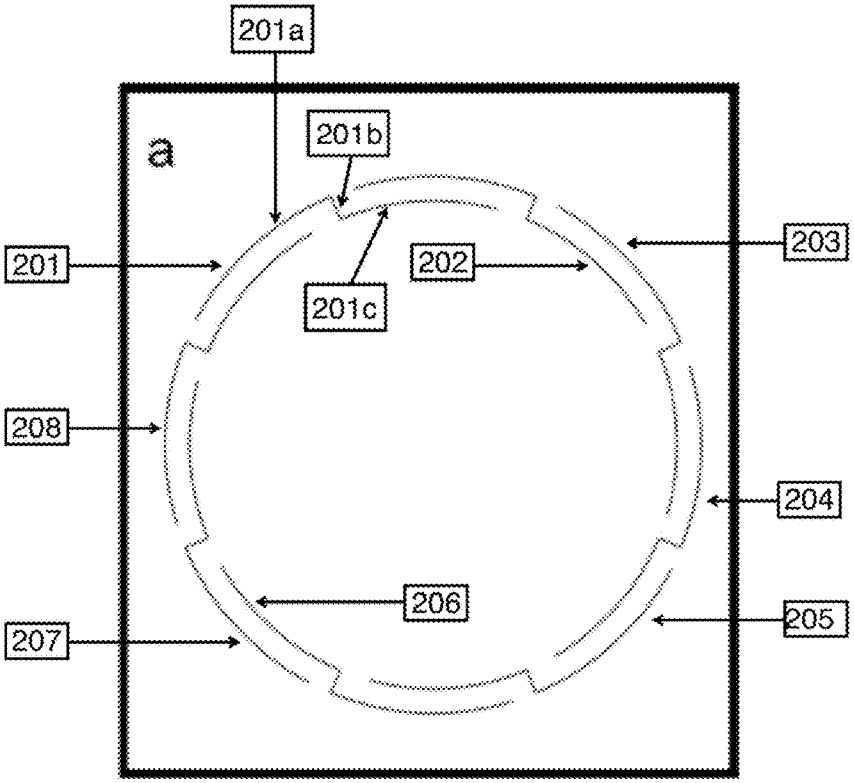
FIG. 2A shows an example of a schematic illustration of a pattern that can be used to soften a membrane. This combination of radial and azimuthal cuts can allow for the center circle lift and rotate as shown in FIG. 2B.
Figure 2B:
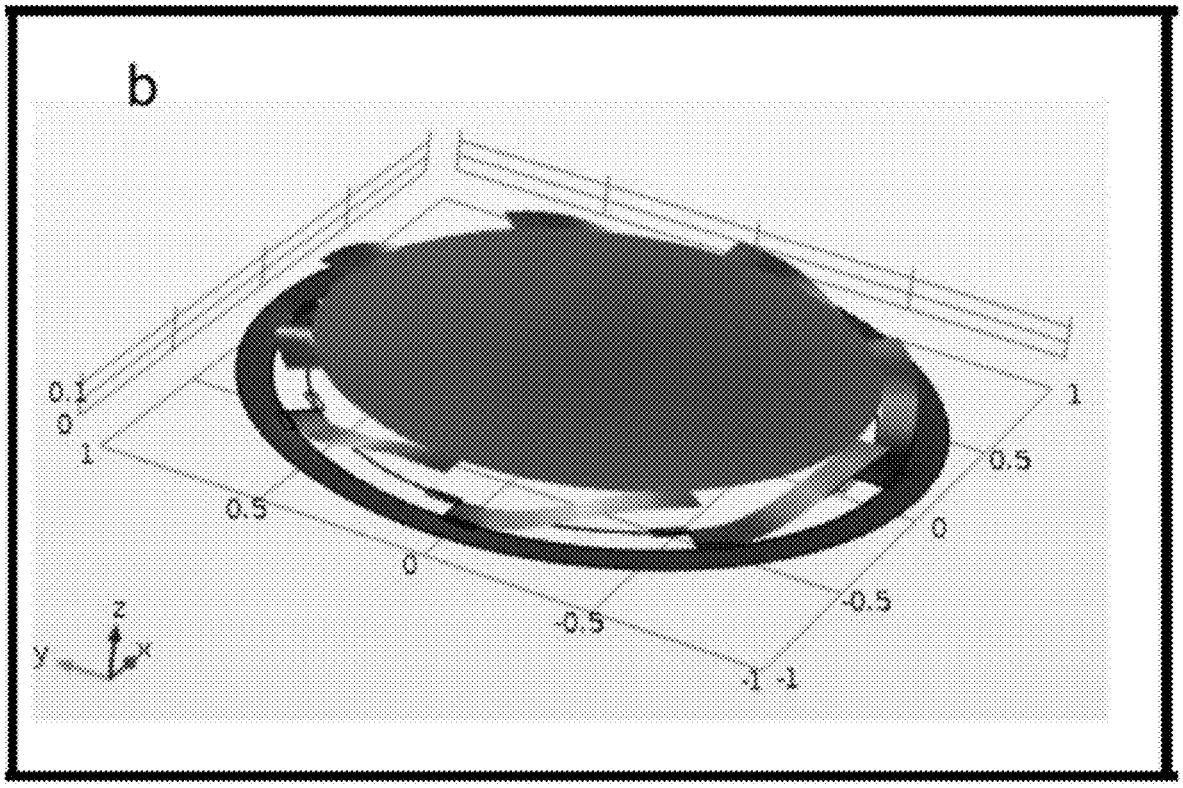
FIG. 2B shows an example of a three-dimension simulation of a uniform force being applied to graphene membrane with the pattern shown in FIG. 2A.

FIGS. 2A and 2B show diagrams of embodiments of the subject matter of the present application, in which a graphene is etched to adjust its frequency and bandwidth. FIG. 2A shows an embodiment of a pattern used to reduce the effective spring constant of a membrane. FIG. 2A includes a pattern of eight lines 201-208, in which each line includes radial and azimuthal portions. For example, line 201 includes first azimuthal portion 201*a*, radial portion 201*b*, and second azimuthal portion 201*c*. Each line in FIG. 2B represents a cut made in the membrane. FIG. 2B shows the 3D COMSOL Multiphysics simulation result of a uniform force being applied to graphene membrane with the example pattern in FIG. 2A. The diameter of the membrane is 1 mm with force of 500 nN.

Figure 3A:
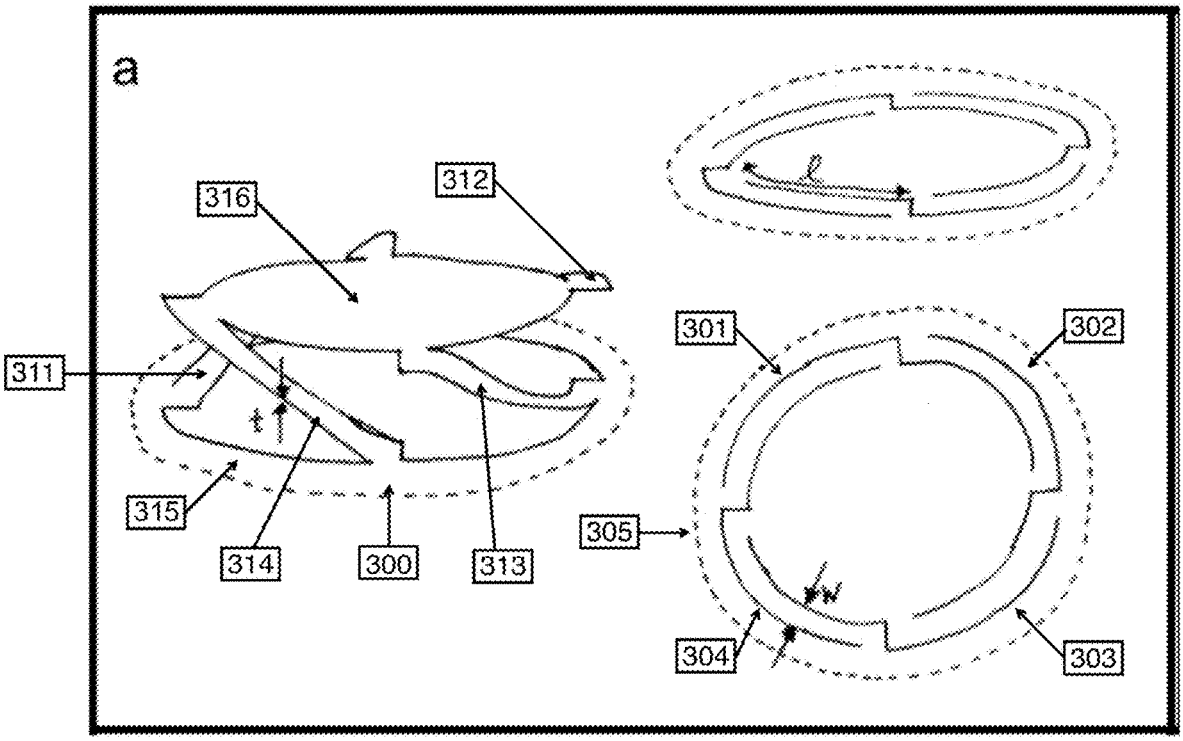
FIG. 3A shows examples of schematic illustrations showing the length (l), the thickness (t), and the width (w) of a flexure beam for a pattern with four flexure beams for a patterned membrane.

FIG. 3A shows three views of an embodiment of a diaphragm 300 that has been cut using a pattern similar to the pattern shown in FIG. 2A. Whereas the cutting pattern in FIG. 2B shows eight lines 201-208 corresponding to eight separate cutes, the cutting pattern in FIG. 3A requires only four cuts, represented by lines 301-304. A person of ordinary skill in the art will understand, however, the number of cuts may be adjusted according to the subject matter of the present application to tune the response of the diaphragm. Similar to FIG. 2A, each line 301-304 includes radial and azimuthal portions. For example, line 301 includes first azimuthal portion 301*a*, radial portion 301*b*, and second azimuthal portion 301*c*. Dotted line 305 represents the perimeter of the diaphragm 300. After being cut along lines 301-304, the diaphragm 300 in FIG. 3A has four flexure beams 311-314, as well as a circumferential region 315 and a central region 316. FIG. 3A shows the circumferential region 315 and the central region 316 lie on different planes. FIG. 3A specifically depicts central region 316 is above circumferential region 315, however normal operation of a transducer including diaphragm 300, central region 316 may also be below circumferential region 316 or coplanar with the same as the diaphragm 300 vibrates. The cuts also permit the central region 316 to rotate in relation to circumferential region 315. Figure also depicts the length (l), the thickness (t), and the width (w) of a flexure beam. The length (l), the thickness (t), and the width (w) of a flexure beams may be customized and/or modified to tune the response of the diaphragm.

Figure 3B:
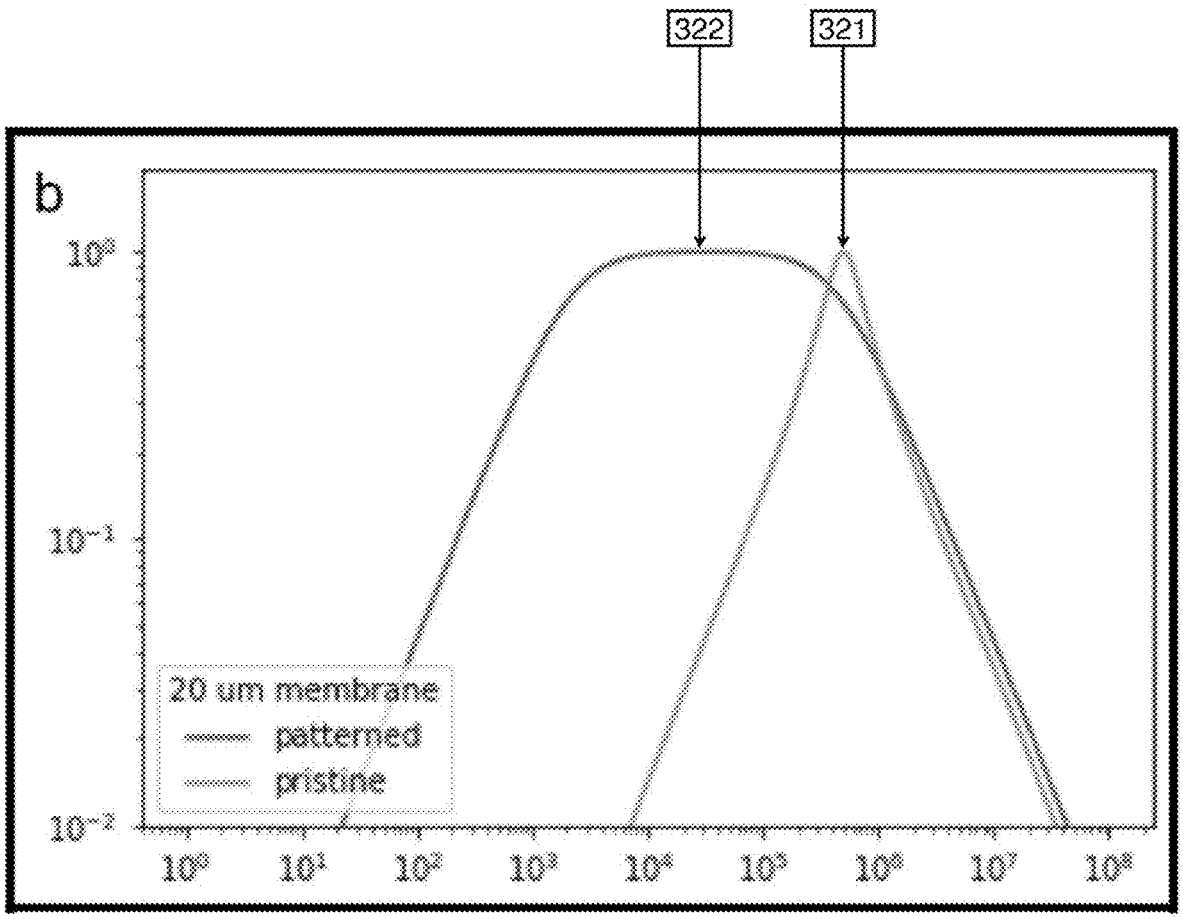
FIG. 3B show the frequency response of the patterned membrane shown in FIG. 3A versus the frequency response of the membrane shown in FIG. 1A for membrane radii of 20 microns.
Figure 3C:
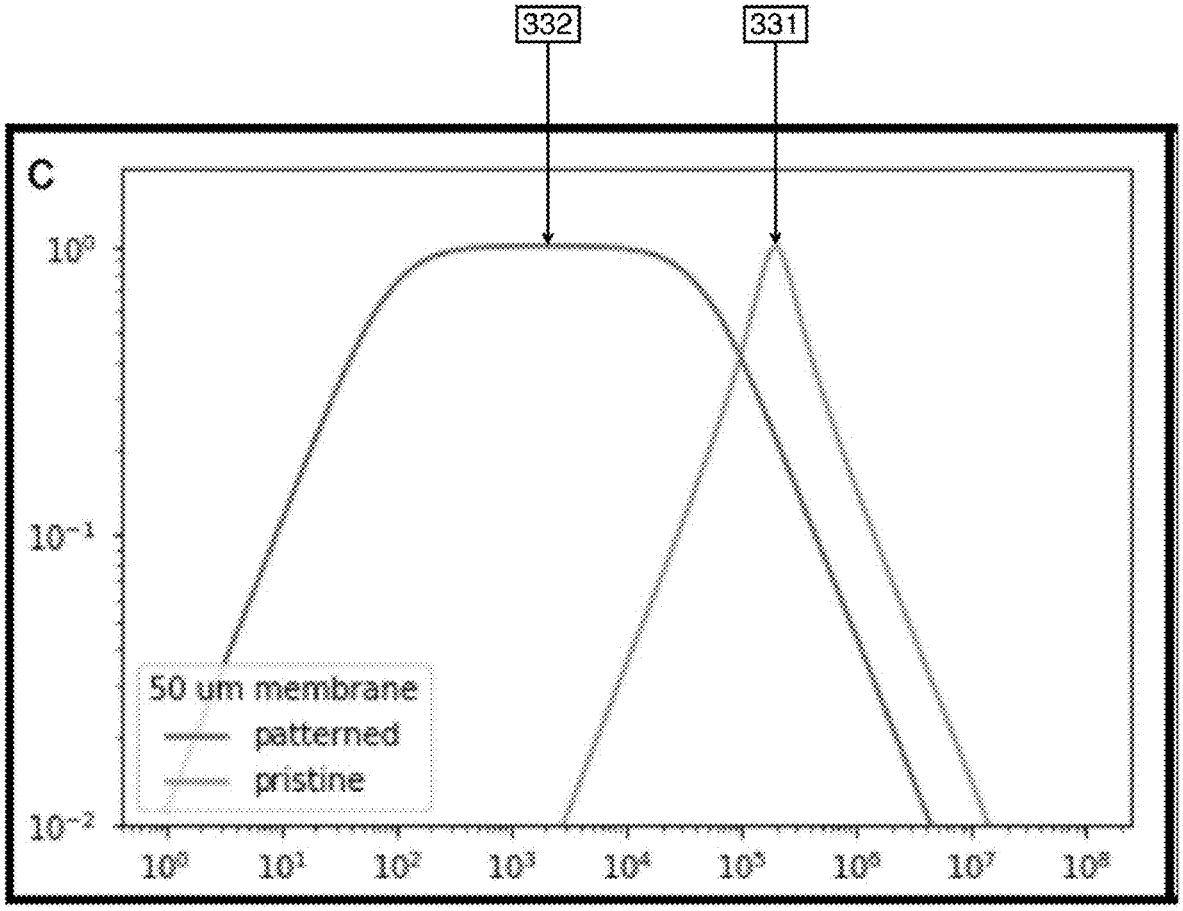
FIG. 3C show the frequency response of the patterned membrane shown in FIG. 3A versus the frequency response of the membrane shown in FIG. 1A for membrane radii of 50 microns.
Figure 3D:
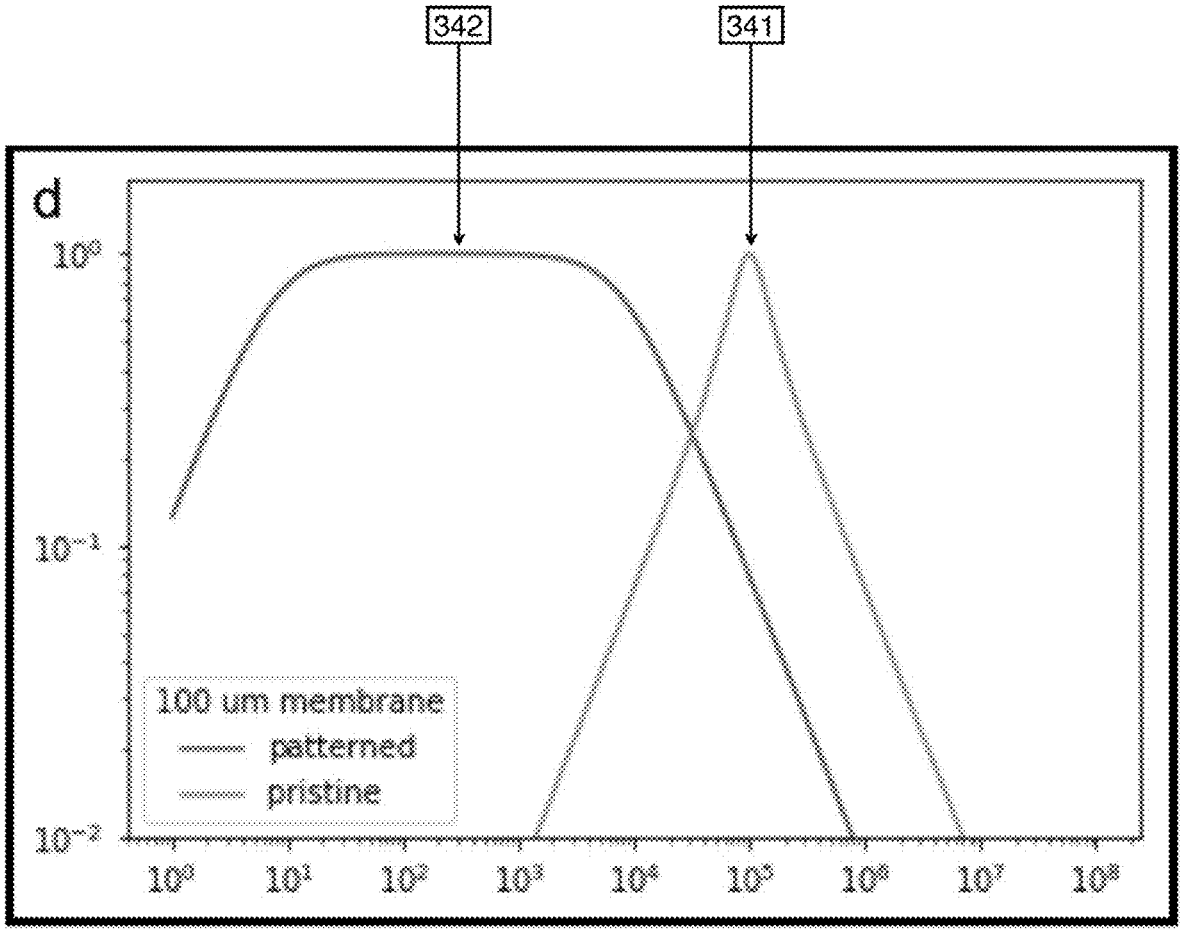
FIG. 3D show the frequency response of the patterned membrane shown in FIG. 3A versus the frequency response of the membrane shown in FIG. 1A for membrane radii of 100 microns. The patterned membranes consistently demonstrate enhanced resonances at reduced and broadened frequencies.

FIGS. 3B-3D show how a graphene membrane patterned and etched in the configuration shown in FIGS. 2A and 2B changes its mechanical response compared to an unpatterned graphene membrane of the same diameter.

In FIG. 3B, line 321 corresponds to a pristine graphene membrane having a radius of 20 μm, and line 322 corresponds to a patterned graphene membrane having the same radius, in which the pattern applied has the configuration shown in FIG. 2A.

In FIG. 3C, line 331 corresponds to a pristine graphene membrane having a radius of 50 μm, and line 332 corresponds to a patterned graphene membrane having the same radius, in which the pattern applied has the configuration shown in FIG. 2A.

In FIG. 3D, line 341 corresponds to a pristine graphene membrane having a radius of 100 μm, and line 342 corresponds to a patterned graphene membrane having the same radius, in which the pattern applied has the configuration shown in FIG. 2A.

Figure 2C:
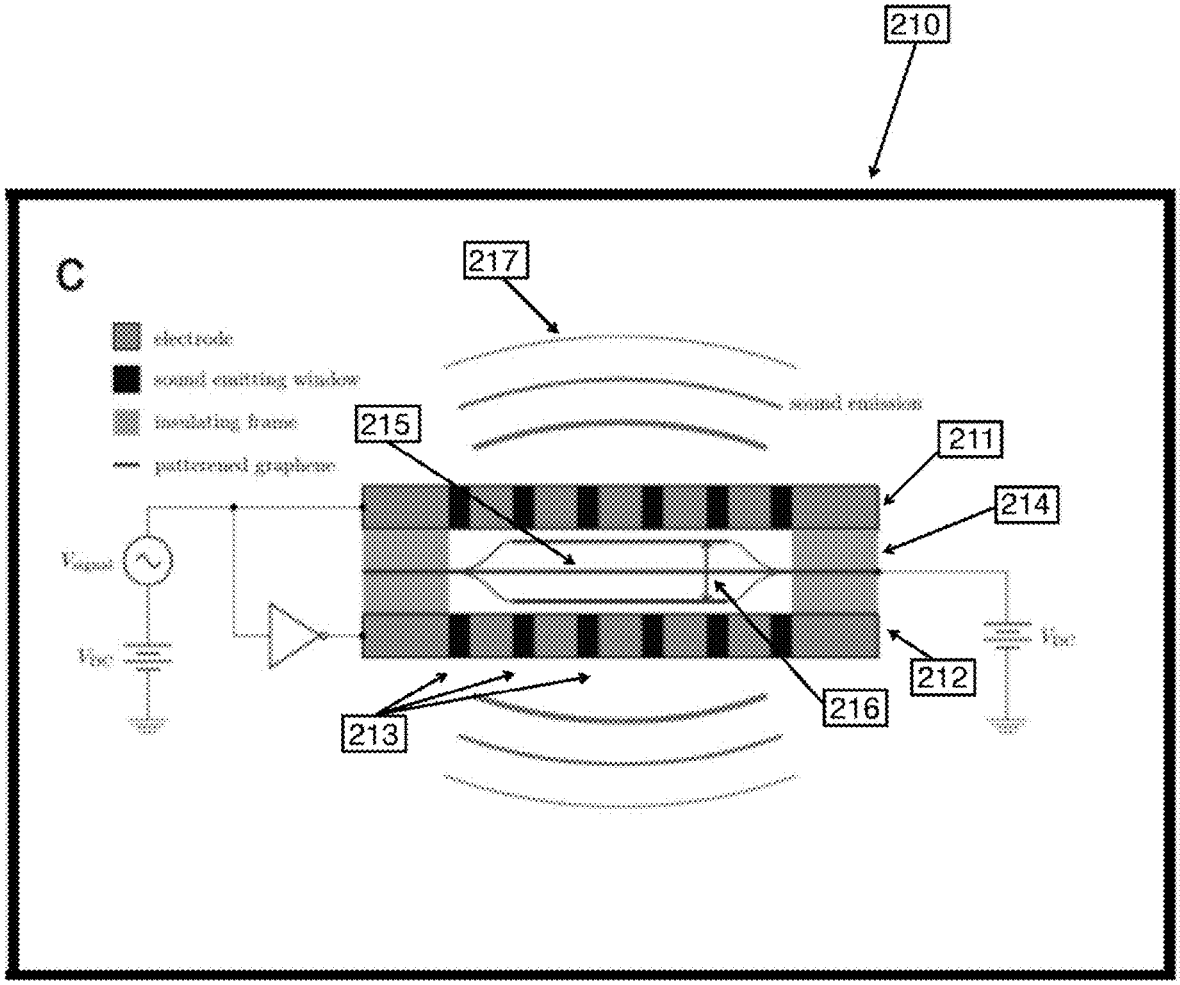
FIG. 2C shows an example of a cross-sectional schematic illustration of a speaker including a patterned graphene membrane suspended between two perforated electrodes. The speaker shown in FIG. 2C operates in a similar manner as the speaker shown in FIG. 1A, but deliberate geometry tailoring in the speaker shown in FIG. 2C allows for the mode shapes to be changed (depicted by the flexures as shown at a lower resonant frequency).

FIG. 2C shows an embodiment of an acoustic transducer 210 including the patterned graphene membrane shown in FIGS. 2A and 2B. The acoustic transducer 210 includes a first electrode 211 and a second electrode 212. Each of the electrodes 211, 212 include a plurality of sound emitting windows 213 and an insulating frame 214. The patterned graphene membrane 215 is arranged in the insulating frame 214. To generate acoustic waves, an AC voltage is applied to the first electrode 211 and the second electrode 212. The AC voltage is inverted between the first electrode 211 and the second electrode 212. The AC voltage capacitively couples to the patterned graphene membrane 215, causing the patterned graphene membrane 215 to oscillate (as shown by arrow 216) with the AC signal due to the electrostatic force on the patterned graphene membrane 215. As the patterned graphene membrane 215 moves in and out of its original plane, air is pushed, producing sound emission 217.

The transducer shown in FIG. 2C is configured as a speaker; however, the transducer may also be configured as a microphone. By measuring the voltage at the electrodes 201, 202 rather than feeding an AC voltage, electrical oscillations can be measured as sound waves excite the motion of the patterned graphene membrane 215. This allows for the acoustic transducer to also be used as a microphone.

Figure 4A:
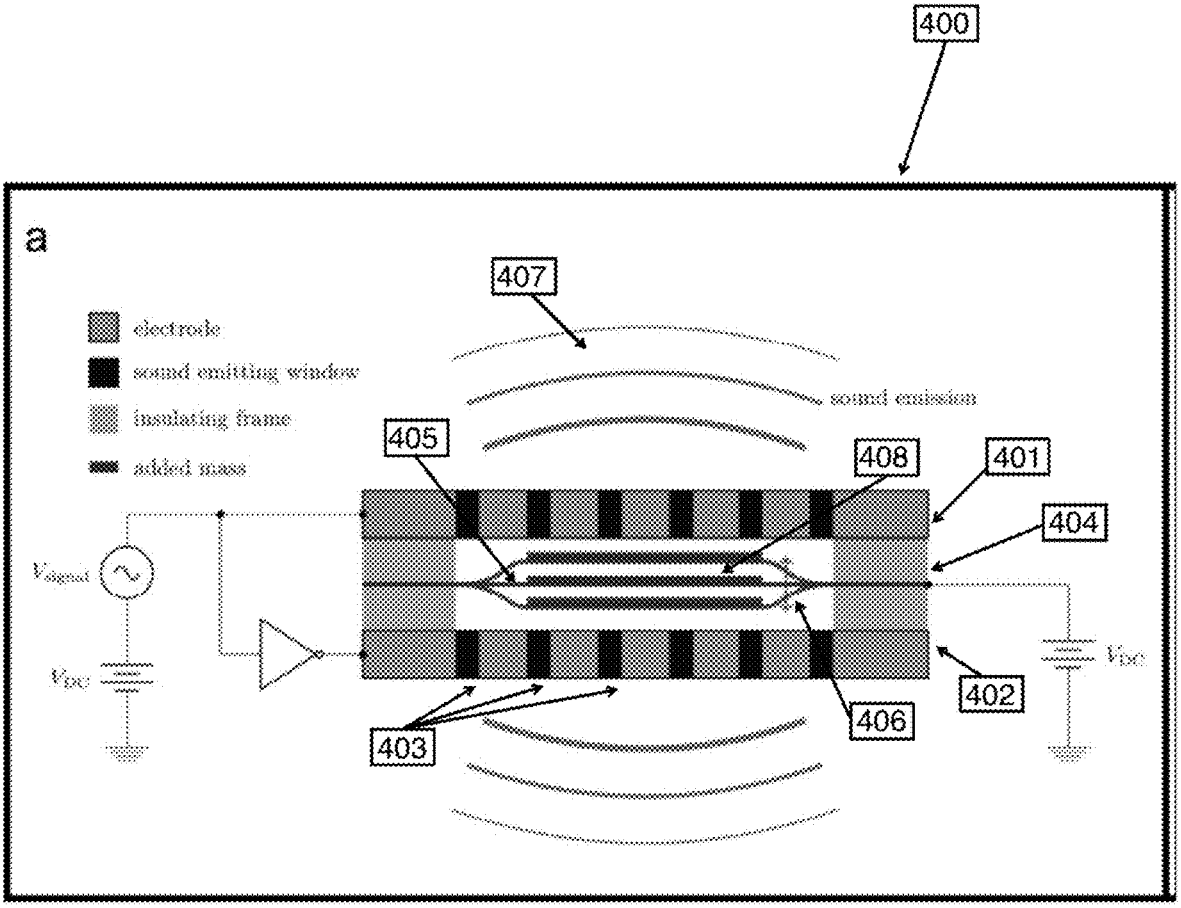
FIG. 4A shows an example of a cross-sectional schematic illustration of a speaker including a mass modified graphene membrane (i.e., a graphene membrane loaded with a mass) suspended between two perforated electrodes.
Figure 4B:
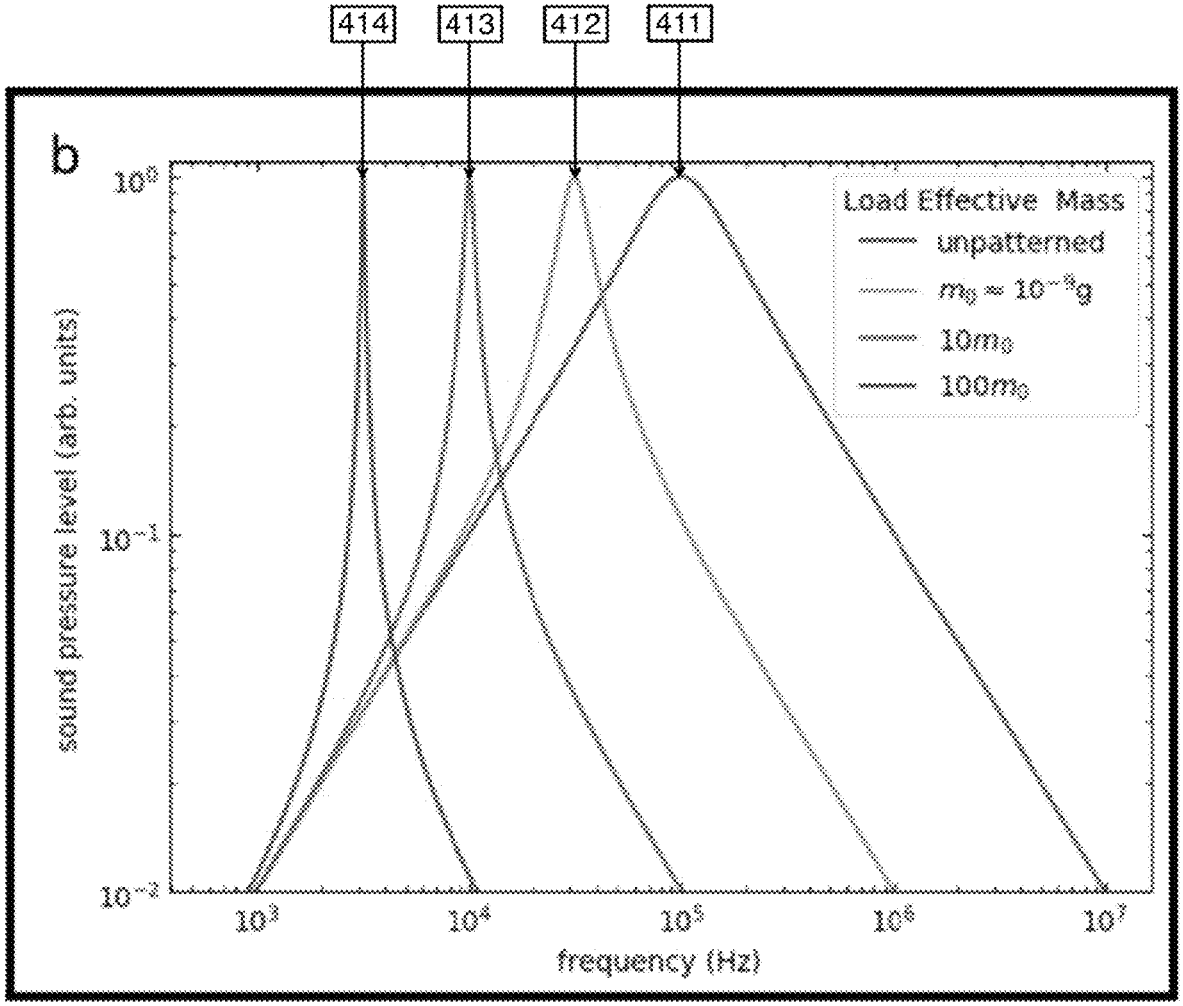
FIG. 4B shows the frequency response of a mass modified graphene membrane. By loading mass around the center of the graphene membrane, the frequency response can be sharpened and reduced.

FIGS. 4A and 4B show an embodiment of a transducer 400 with mass loading of a graphene membrane 405. The transducer shown in in FIG. 4A is similar to the transducer shown in FIG. 2C, and contains many of the same components, including first and second electrodes 401, 402 having a plurality of sound emitting windows 403 and an insulating frame 404. To generate acoustic waves, an AC voltage is applied to the first electrode 401 and the second electrode 402 in the same manner as described with regarding to FIG. 2C. The graphene membrane 405 also has a mass 408. This mass loading can be used to adjust the frequency and the bandwidth of the graphene membrane 405.

FIG. 4B shows an example of the frequency response change with a mass in the shape of a thin disk being attached to a surface of the graphene membrane 405. Line 411 corresponds to a graphene membrane with no mass loading, line 412 corresponds to a graphene membrane having an added thin disk of mass $m_o$ of approximately 1 nanogram ($10^{-9}$ g), line 413 corresponds to a graphene membrane having an added thin disk of mass of 10 $m_o$, and line 414 corresponds to a graphene membrane having an added thin disk of mass of 100 $m_o$. With increasing mass of the thin disk, the resonance frequency decreases and the full width at half maximum decreases, allowing tuning of these properties.

Figure 5A:
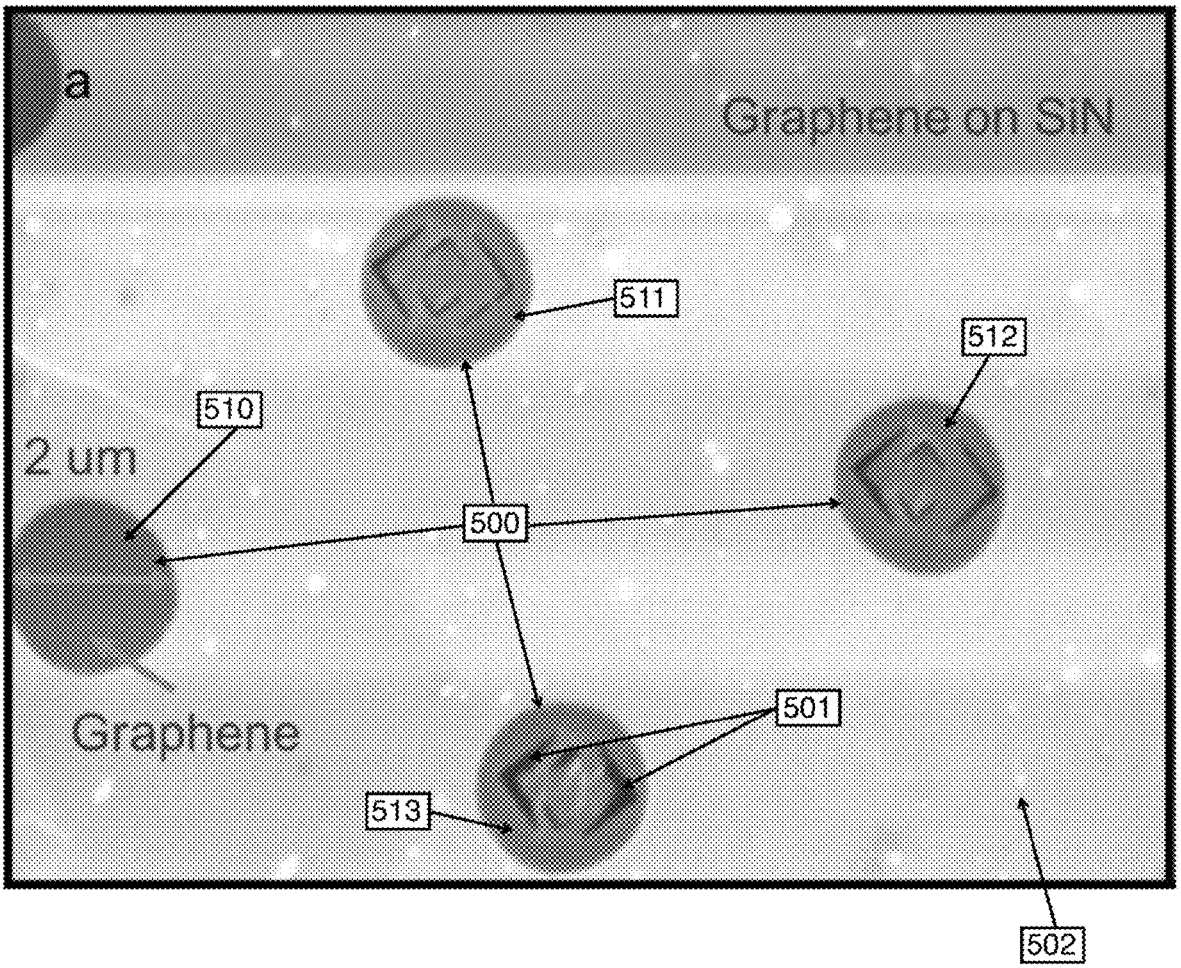
FIGS. 5A and 5B show examples of patterned graphene membranes that were patterned using helium ion milling.
Figure 5B:
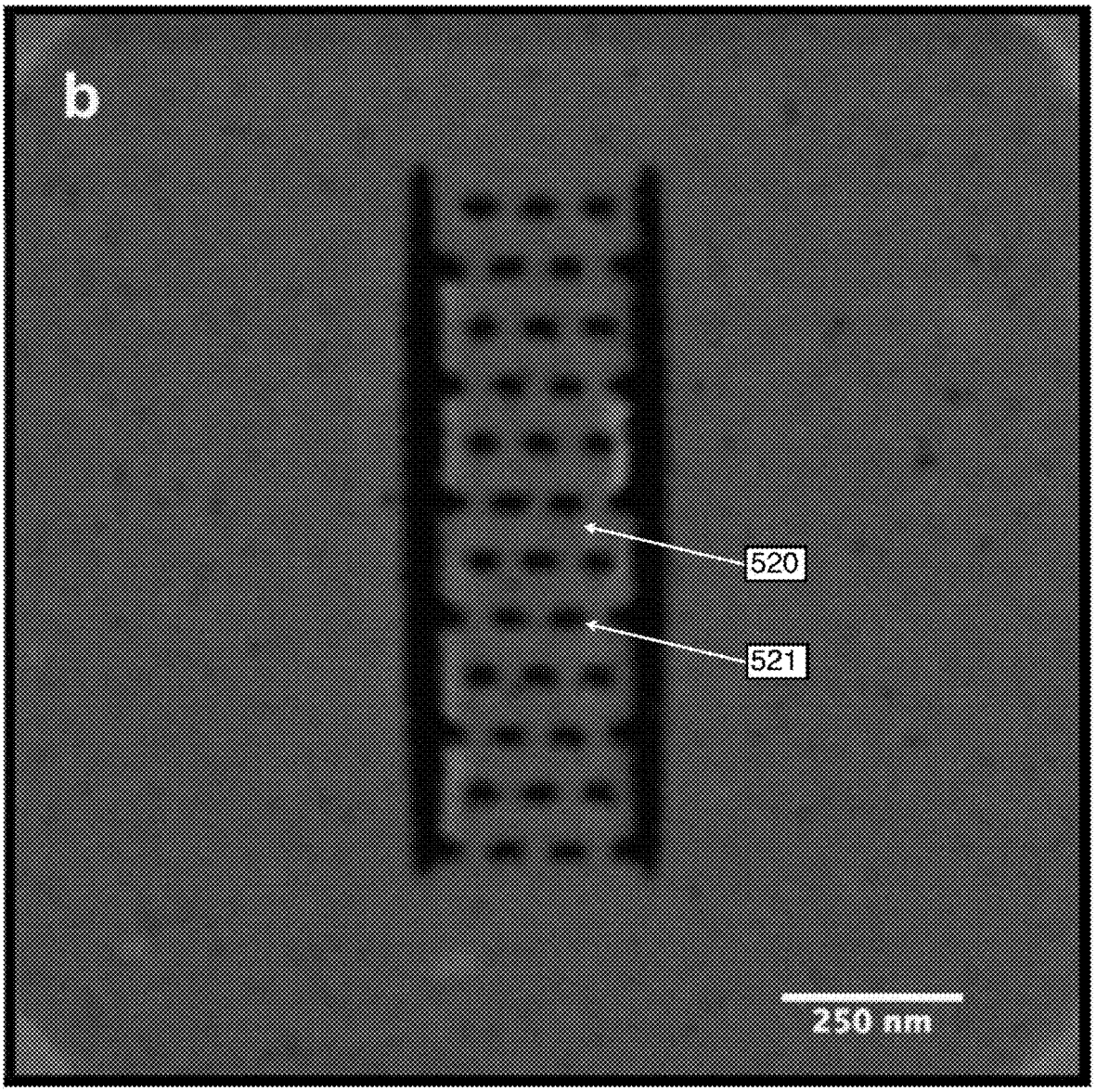

FIGS. 5A and 5B show examples of patterned graphene membranes 500 that were patterned using helium ion milling. In FIG. 5A, the graphene membranes 500 are gray, open regions 501 cut out of the graphene membrane are black, and the silicon nitride 502 on which the graphene membranes are disposed is white. FIG. 5A shows one pristine graphene membrane 510 (i.e., unpatterned) suspended over a hole in a metal-coated silicon nitride (SiN) membrane (left) and three patterned graphene membranes 511-513 suspended over holes in the metal-coated SiN membrane (right) as imaged by scanning electron microscopy. The patterned graphene membranes 511-513 have v-shaped holes or perforations 501.

FIG. 5B shows an example of a patterned graphene beam 520 that has had its resonant properties softened. The patterned graphene beam 520 has circular holes or perforations 521.

Embodiments described herein may also address issues experienced with graphene membranes incorporated in some acoustic transducers. The graphene membrane incorporated in some acoustic transducers may be heavily tensioned and wrinkled. This reduces the mechanical stability of graphene membrane and can cause it to break. This may also reduce the amplitude of oscillation of the graphene membrane. Patterning a graphene membrane by defining cuts or holes in the membrane, as described above, reduces the tension and wrinkling of the membrane. The cuts or holes in a graphene membrane allow the membrane to expand and contract, improving the mechanical stability of the membrane and increasing the oscillating amplitude of the membrane.

Graphene membranes may be made using techniques set forth in U.S. patent application Ser. No. 14/737,903 and U.S. patent application Ser. No. 15/558,467.

The membranes of the present application are generally smaller than 1 mm in diameter. In some embodiments, the membranes have a diameter between 1 μm and 1 mm. In some embodiments, the membranes have a diameter between 10 μm and 1 mm. In some embodiments, the membranes have a diameter between 100 μm and 1 mm. In some embodiments, the membranes have a diameter between 1 μm and 100 μm. In some embodiments, the membranes have a diameter between 10 μm and 100 μm. In some embodiments, the membranes have a diameter between 1 μm and 10 μm. In some embodiments, the membranes have a diameter between 20 μm and 100 μm. In some embodiments, the membranes have a diameter between 20 μm and 50 μm. In some embodiments, the membranes have a diameter between 50 μm and 100 μm.

In some embodiments, the membranes of the present application comprise graphene. In some embodiments, the membrane comprises monolayer graphene. In some embodiments, the membrane comprises multilayer graphene. In some embodiments, the membrane has a thickness of 20 nanometers to 40 nanometers. In some embodiments, the membrane is 10 nanometers to 100 microns thick. In some embodiments, the membrane has a thickness of 20 nanometers to 400 nanometers.

In some embodiments, the transducers of the present application show a frequency response from 20 Hz to 20 kHz. In some embodiments, the transducers show a frequency response from 20 Hz. To 200 kHz. In some embodiments, the transducers show a frequency response from 20 Hz to 500 kHz. In some embodiments, the transducers show a frequency response from 20 Hz to 10 MHz. In some embodiments, the transducers show a frequency response from 20 Hz to 10 GHz. In some embodiments, the transducers show a frequency response from 20 kHz to 200 kHz. In some embodiments, the transducers show a frequency response from 20 kHz to 500 kHz. In some embodiments, the transducers show a frequency response from 20 kHz to 10 MHz. In some embodiments, the transducers show a frequency response from 20 kHz to 10 GHz. In some embodiments, the transducers show a frequency response from 200 kHz to 500 kHz. In some embodiments, the transducers show a frequency response from 200 kHz to 10 MHz. In some embodiments, the transducers show a frequency response from 200 kHz to 10 GHz. In some embodiments, the transducers show a frequency response from 500 kHz to 10 MHz. In some embodiments, the transducers show a frequency response from 500 kHz to 10 GHz. In some embodiments, the transducers show a frequency response from 10 MHz to 10 GHz.

In one embodiment, the present application provides a device comprising a membrane, in which the membrane is electrically conductive. A portion of this membrane is configured to or operable to generate or detect an acoustic wave, and this portion has a size about 1 micron to 1 millimeter in diameter. The membrane further has either radial cuts and azimuthal cuts defined therein, open regions defined therein, or a mass disposed thereon. The device also includes a first electrode proximate a first side of the membrane, the first electrode being electrically conductive. The device also includes a second electrode proximate a second side of the membrane, the second electrode being electrically conductive, the membrane being suspended between the first electrode and the second electrode.

In another embodiment, the radial cuts and the azimuthal cuts in the membrane function to allow a central circular portion of the membrane to be in a different plane and rotated relative to edges of the membrane.

In another embodiment, the membrane has open regions defined therein. In another embodiment, the open regions comprise substantially circular holes. In another embodiment, the substantially circular holes have a diameter of about 20 nanometers to 60 nanometers. In another embodiment, the open regions comprise V-shaped open regions.

In another embodiment, the membrane has a mass disposed thereon. In another embodiment, the mass comprises a circularly shaped mass. In another embodiment, the mass comprises a metal.

In another embodiment, the membrane comprises single layer graphene, multilayer graphene, a single layer of a two-dimensional material, multiple layers of a two-dimensional material, a metal, a semiconductor, or a polymer film. In another embodiment, the membrane comprises single layer graphene or multilayer graphene. In another embodiment the membrane comprises single layer graphene. In another embodiment, the membrane comprises multilayer graphene. In another embodiment, the membrane is about 20 nanometers to 40 nanometers thick. In another embodiment, the membrane is about 10 nanometers to 100 microns thick.

In another embodiment, the device is operable to convert the acoustic wave to an electrical signal. In another embodiment, the device is operable to convert an electrical signal to the acoustic wave.

In another embodiment, the first electrode has a first non-conductive layer disposed thereon. In another embodiment, the second electrode has a second non-conductive layer disposed thereon. These non-conductive layers prevent a short circuit or arcing between the membrane and the electrodes.

In another embodiment, the device a first frame disposed on the first side of the membrane and a second frame disposed on the second side of the membrane. The first frame and the second frame both include substantially circular open regions that define a substantially circular portion of the membrane operable to generate or to detect the acoustic wave. In another embodiment, the first frame and the second frame are about 60 microns to 180 microns thick.

In another embodiment, the first electrode is in contact with the first frame, wherein the first electrode is spaced a first distance of about 60 microns to 180 microns from the first side of the membrane, wherein the second electrode is in contact with the second frame, and wherein the second electrode is spaced a second distance of about 60 microns to 180 microns from the second side of the membrane.

In another embodiment, the first electrode and the second electrode define open regions having a dimension of about 200 microns to 300 microns. In another embodiment, the first electrode and the second electrode comprise silicon wafers.

In another embodiment, the device includes a wire in electrical contact with the graphene membrane. In another embodiment, the wire is a gold wire with a diameter of about 10 microns to 30 microns.

In another embodiment, the present application provides a device which comprises a membrane, in which a portion of the membrane is configured to or operable to detect an acoustic wave. The membrane is about 1 micron to 1 millimeter in diameter, and either has radial cuts and azimuthal cuts defined therein, open regions defined therein, or a mass disposed thereon. The device also includes a first electrode proximate a first side of the membrane; and a circuit associated with the first electrode, the circuit being configured to measure a velocity of vibration of the membrane, the vibration being caused by the acoustic wave.

In another embodiment, the device includes a frame supporting the membrane, in which the frame includes a substantially circular open region that defines a substantially circular portion of the membrane operable to detect the acoustic wave.

In another embodiment, the membrane is single layer graphene, multilayer graphene, a single layer of a two-dimensional material, multiple layers of a two-dimensional material, a metal, a semiconductor, or a polymer film. In another embodiment, the membrane comprises single layer graphene or multilayer graphene. In another embodiment, the membrane comprises single layer graphene. In another embodiment, the membrane comprises multilayer graphene. In another embodiment, the membrane is about 20 nanometers to 40 nanometers thick.

In another embodiment, the circuit comprises a resistor and an amplifier and the membrane is connected to a voltage source. Here, the first electrode is connected to a negative input of the amplifier, a positive input of the amplifier is connected to ground, and the resistor is connected to the negative input of the amplifier and an output of the amplifier. In another embodiment, the resistor has a resistance of about 1 megaohms to 10000 megaohms. In another embodiment, the amplifier comprises a low noise operational amplifier. In another embodiment, the voltage source is configured to apply a voltage of about 20 volts to 1000 volts to the membrane.

In another embodiment, the device is configured to generate an output signal through the circuit in response to the sound waves, and wherein the sound waves have a frequency of about 20 Hz to 10 GHz.

In another embodiment, the device includes a first spacer, wherein the first spacer is disposed between the membrane and the first electrode. In another embodiment, the device includes a second electrode proximate a second side of the membrane.

In another embodiment, the present application provides a method comprising: (a) providing a device including a membrane, the membrane being electrically conductive, a portion of the membrane operable to generate or detect an acoustic wave being about 1 micron to 1 millimeter in diameter, the membrane including a feature selected from features consisting of (1) the membrane having radial cuts and azimuthal cuts defined therein, (2) the membrane having open regions defined therein, and (3) the membrane having a mass disposed thereon; a first electrode proximate a first side of the membrane, the first electrode being electrically conductive; and a second electrode proximate a second side of the membrane, the second electrode being electrically conductive, the membrane being suspended between the first electrode and the second electrode; (b) biasing the membrane with a direct current voltage; and (c) biasing the first electrode and the second electrode with an input signal, causing the membrane to move and generate the acoustic wave.

In another embodiment, the input signal is generated from an audio signal. In another embodiment, the direct current voltage is about 50 volts to 150 volts. In another embodiment, an amplitude of the input signal is about 0 volts to 15 volts. In another embodiment, the first electrode and the second electrode are biased at opposite polarities. In another embodiment, the membrane comprises single layer graphene, multilayer graphene, a single layer of a two-dimensional material, multiple layers of a two-dimensional material, a metal, a semiconductor, or a polymer film.

In another embodiment, the present application provides a method for preparing a graphene diaphragm, the method comprising: (a) providing a graphene diaphragm; (b) modifying the graphene diaphragm using a technique selected from the group consisting of etching of the graphene, mass-loading of the graphene, or chemical modification of the graphene, wherein such modifying step adjusts the frequency, bandwidth, amplitude, or directionality of the acoustics of the graphene diaphragm. In another embodiment, the modifying step includes ion beam irradiation, laser irradiation, electron beam lithography, photolithography, or metal evaporation.

In some embodiments, the etching, mass-loading, or chemical modification of the membrane creates cuts in the membrane. These cuts reduce the spring constant of the membrane and therefore "soften" the membrane as compared to a membrane without the cuts. In some embodiments, these cuts are radial cuts. In some embodiments, these cuts are azimuthal cuts. In some embodiments, these cuts are radial and azimuthal cuts. In some embodiments, the cuts permit a central region of the membrane to be in a different plane and rotated relative to the edges of the membrane. With patterned cuts, the graphene membrane stiffness can be softened allowing for broader and lower frequency responses. The mechanical properties of the patterned graphene membrane are determined, in part, by the width, the length, and the number of cuts. The frequency response of a graphene membrane can be changed by changing the geometry and number of these cuts.

In some embodiments, the etching, mass loading, or chemical modification of the membrane creates open regions in the graphene membrane. The open regions reduce the spring constant of the membrane and therefore "soften" the membrane as compared to a membrane without openings. In some embodiments, these open regions may be slits, holes, or other openings. In some embodiments, the holes are circular shaped. In some embodiments the holes are v-shaped, square, elliptical, kidney, star, n-polygonal, etc. In some embodiments, the holes have a diameter of about 20 nanometers to 60 nanometers.

In some embodiments, the mass of the graphene membrane is reduced. For example, in some embodiments, the mass of the graphene membrane is reduced by defining holes in the graphene membrane. This may be referred to as perforating the membrane. A graphene membrane defining regular holes reduces the mass and damping of the membrane and increases the resonant frequency of the membrane. In some embodiments, the holes are circular shaped. In some embodiments the holes are v-shaped, square, elliptical, kidney, star, n-polygonal, etc. In some embodiments, the holes have a diameter of about 20 nanometers to 60 nanometers.

In some embodiments, the etching, mass loading, or chemical modification of the graphene membrane creates a membrane having a mass disposed thereon. In some embodiments, the mass is a circularly shaped mass. In some embodiments, the mass is v-shaped, square, elliptical, kidney, star, n-polygonal, etc. In some embodiments, the mass comprises a metal.

In some embodiments, a mass is deposited on a surface of the graphene membrane in an anisotropic pattern. This approach would split the fundamental resonant frequencies, allowing for multiple peaks in the audible range. In some embodiments, by changing the mass and pattern of the material deposited on the graphene membrane, the full width at half maximum of the frequency response can be reduced, allowing for sharp frequency responses in the audible-acoustic regime (FIG. 4B). In some embodiments, this feature can be used an integrated band pass filter for sound generation and detection.

In another embodiment, the present application includes a device incorporating a transducer having a membrane according to the present application. Such device may be, for example a sensor, smartphone, wearable device, speaker, microphone, headset, computer, or the like. In another embodiment, the device includes include a plurality of such transducers, in which some are configured to generate sound waves and others are configured to detect sound waves. In another embodiment, the each of the plurality of such transducers may be configured to generate or detect sound waves by the device during use, so that each individual transducer may change configuration as needed and on demand.

CONCLUSION

The foregoing description of preferred embodiments has been presented for purposes of illustration and description only. It is not intended to be exhaustive or to limit the application to the precise form disclosed, and modifications and variations are possible and/or would be apparent in light of the above teachings or may be acquired from practice of the application. The embodiments were chosen and described in order to explain the principles of the application and its practical application to enable one skilled in the art to utilize the application in various embodiments and with various modifications as are suited to the particular use contemplated. It is intended that the scope of the application be defined by the claims appended hereto. One of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. A device comprising:

a membrane, the membrane being electrically conductive, a portion of the membrane operable to perform at least one of generating or detecting an acoustic wave being about 1 micron to 1 millimeter in diameter, the membrane including a feature selected from features consisting of (1) the membrane having radial cuts and azimuthal cuts defined therein, (2) the membrane having open regions defined therein, and (3) the membrane having a mass disposed thereon;

a first electrode proximate a first side of the membrane, the first electrode being electrically conductive;

a second electrode proximate a second side of the membrane, the second electrode being electrically conductive, the membrane being suspended between the first electrode and the second electrode;

a first frame disposed on the first side of the membrane; and a second frame disposed on the second side of the membrane, the first frame and the second frame both including substantially circular open regions that define a substantially circular portion of the membrane operable to perform the at least one of the generating or the detecting the acoustic wave.

2. The device of claim 1, wherein the membrane has the radial cuts and the azimuthal cuts defined therein, and wherein the radial cuts and the azimuthal cuts function to allow a central circular potion of the membrane to be in a different plane and rotated relative to edges of the membrane.

3. The device of claim 1, wherein the membrane has open regions defined therein, and wherein the open regions comprise substantially circular holes.

4. The device of claim 3, wherein the substantially circular holes have a diameter of about 20 nanometers to 60 nanometers.

5. The device of claim 1, wherein the membrane has open regions defined therein, and wherein the open regions comprise V-shaped open regions.

6. The device of claim 1, wherein the membrane has a mass disposed thereon, and wherein the mass comprises a circularly shaped mass.

7. The device of claim 1, wherein the membrane has a mass disposed thereon, and wherein the mass comprises a metal.

8. The device of claim 1, wherein the membrane comprises single layer graphene or multilayer graphene.

9. The device of claim 1, wherein the membrane comprises single layer graphene, multilayer graphene, a single layer of a two-dimensional material, multiple layers of a two-dimensional material, a metal, a semiconductor, or a polymer film.

10. The device of claim 1, wherein the membrane comprises graphene, and wherein the membrane is about 20 nanometers to 40 nanometers thick.

11. The device of claim 1, wherein the membrane is about 10 nanometers to 100 microns thick.

12. The device of claim 1, wherein the device is operable to convert the acoustic wave to an electrical signal.

13. The device of claim 1, wherein the device is operable to convert an electrical signal to the acoustic wave.

14. The device of claim 1, wherein the first electrode has a first non-conductive layer disposed thereon, and wherein the second electrode has a second non-conductive layer disposed thereon.

15. The device of claim 1, wherein the first frame and the second frame are about 60 microns to 180 microns thick.

16. The device of claim 1, wherein the first electrode is in contact with the first frame, wherein the first electrode is spaced a first distance of about 60 microns to 180 microns from the first side of the membrane, wherein the second electrode is in contact with the second frame, and wherein the second electrode is spaced a second distance of about 60 microns to 180 microns from the second side of the membrane.

17. The device of claim 1, wherein the first electrode and the second electrode define open regions having a dimension of about 200 microns to 300 microns.

18. The device of claim 1, wherein the first electrode and the second electrode comprise silicon wafers.

19. The device of claim 1, further comprising:

a wire in electrical contact with the membrane.

20. The device of claim 19, wherein the wire is a gold wire with a diameter of about 10 microns to 30 microns.

21. A device comprising:

a membrane, a portion of the membrane operable to detect an acoustic wave being about 1 micron to 1 millimeter in diameter, the membrane including a feature selected from features consisting of (1) the membrane having radial cuts and azimuthal cuts defined therein, (2) the membrane having open regions defined therein, and (3) the membrane having a mass disposed thereon;

a first electrode proximate a first side of the membrane;

a circuit associated with the first electrode, the circuit being configured to measure a velocity of vibration of the membrane, the vibration being caused by the acoustic wave; and a frame supporting the membrane, wherein the frame includes a substantially circular open region that defines a substantially circular portion of the membrane operable to detect the acoustic wave.

22. The device of claim 21, wherein the membrane comprises single layer graphene, multilayer graphene, a single layer of a two-dimensional material, multiple layers of a two-dimensional material, a metal, a semiconductor, or a polymer film.

23. The device of claim 21, wherein the membrane comprises single layer graphene or multilayer graphene.

24. The device of claim 21, wherein the membrane comprises graphene, and wherein the membrane is about 20 nanometers to 40 nanometers thick.

25. The device of claim 21, wherein the circuit comprises a resistor and an amplifier, wherein the membrane is connected to a voltage source, wherein the first electrode is connected to a negative input of the amplifier, wherein a positive input of the amplifier is connected to ground, and wherein the resistor is connected to the negative input of the amplifier and an output of the amplifier.

26. The device of claim 25, wherein the resistor has a resistance of about 1 megaohms to 10000 megaohms.

27. The device of claim 25, wherein the amplifier comprises a low noise operational amplifier.

28. The device of claim 25, wherein the voltage source is configured to apply a voltage of about 20 volts to 1000 volts to the membrane.

29. The device of claim 21, wherein the device is configured to generate an output signal through the circuit in response to sound waves, and wherein the sound waves have a frequency of about 20 Hz to 10 GHz.

30. The device of claim 21, further comprising:

a first spacer, wherein the first spacer is disposed between the membrane and the first electrode.

31. The device of claim 21, further comprising:

a second electrode proximate a second side of the membrane.

32. A method comprising:

(a) providing a device including:

a membrane, the membrane being electrically conductive, a portion of the membrane operable to perform at least one of generating or detecting an acoustic wave being about 1 micron to 1 millimeter in diameter, the membrane including a feature selected from features consisting of (1) the membrane having radial cuts and azimuthal cuts defined therein, (2) the membrane having open regions defined therein, and (3) the membrane having a mass disposed thereon;

a first electrode proximate a first side of the membrane, the first electrode being electrically conductive; and a second electrode proximate a second side of the membrane, the second electrode being electrically conductive, the membrane being suspended between the first electrode and the second electrode;

(b) biasing the membrane with a direct current voltage; and (c) biasing the first electrode and the second electrode with an input signal, causing the membrane to move and generate the acoustic wave, wherein the input signal is generated from an audio signal.

33. The method of claim 32, wherein the direct current voltage is about 50 volts to 150 volts.

34. The method of claim 32, wherein an amplitude of the input signal is about 0 volts to 15 volts.

35. The method of claim 32, wherein in operation (c), the first electrode and the second electrode are biased at opposite polarities.

36. The method of claim 32, wherein the membrane comprises single layer graphene, multilayer graphene, a single layer of a two-dimensional material, multiple layers of a two-dimensional material, a metal, a semiconductor, or a polymer film.

* * * * *